US008356414B2

(12) United States Patent
Wendorf et al.

(10) Patent No.: US 8,356,414 B2
(45) Date of Patent: Jan. 22, 2013

(54) NAIL CLIPPING APPARATUS

(75) Inventors: Jared Wendorf, Elk Grove Village, IL (US); Amanda Snyder, Berwyn, PA (US); Alyce Miller, Lake Charles, LA (US); Benjamin Mattson, Eden Prairie, MN (US)

(73) Assignee: Northwestern University, Evanston, IL (US)

( * ) Notice: Subject to any disclaimer, the term of this patent is extended or adjusted under 35 U.S.C. 154(b) by 829 days.

(21) Appl. No.: 12/075,099

(22) Filed: Mar. 7, 2008

(65) Prior Publication Data

US 2009/0223055 A1 Sep. 10, 2009

(51) Int. Cl.
*A45D 29/00* (2006.01)

(52) U.S. Cl. ..... 30/26; 30/27; 30/28

(58) Field of Classification Search ..... 30/28, 26, 30/27, 253, 254; 132/75.5, 75.8, 76.2, 73; D8/60–62

See application file for complete search history.

(56) References Cited

U.S. PATENT DOCUMENTS

| | | | | | |
|---|---|---|---|---|---|
| 2,616,436 | A | * | 11/1952 | Langley | 132/75.5 |
| 2,753,626 | A | * | 7/1956 | Bowers | 30/28 |
| 3,903,596 | A | * | 9/1975 | Crosby | 30/29 |
| 4,176,449 | A | * | 12/1979 | Lee et al. | 30/28 |
| 5,052,416 | A | * | 10/1991 | Rommerdale | 132/75.5 |
| 5,357,677 | A | | 10/1994 | West | |
| D361,865 | S | * | 8/1995 | Tosolt | D28/60 |
| 5,546,658 | A | * | 8/1996 | MacLeod et al. | 30/28 |
| 6,539,632 | B2 | | 4/2003 | Anctil | |
| 6,601,587 | B2 | | 8/2003 | Shaw | |
| 7,020,964 | B2 | * | 4/2006 | Han et al. | 30/28 |
| 7,062,855 | B2 | * | 6/2006 | Merheje | 30/28 |
| 7,159,595 | B2 | * | 1/2007 | Cho | 132/73.5 |
| 7,234,238 | B2 | * | 6/2007 | Wong | 30/28 |
| 2003/0145467 | A1 | * | 8/2003 | Yan Lau | 30/28 |
| 2008/0148572 | A1 | * | 6/2008 | Samson | 30/28 |

OTHER PUBLICATIONS

SeniorEmporium.com, Press-On Nail Clipper, Feb. 13, 2008.

* cited by examiner

*Primary Examiner* — Andrea Wellington
*Assistant Examiner* — Omar Flores Sanchez

(57) ABSTRACT

A nail clipping apparatus for cutting a fingernail, thumbnail, or toenail nail of a user, comprising a base having an upstanding support member and a nail clipper disposed on the support member, wherein the nail clipper has a rotatable cutter head actuated to cut the user's nail by pivoting movement of a lower clipper arm upwardly toward and an upper clipper arm on which the cutter head resides, wherein the upper clipper arm is connected to the support member and wherein the lower clipper arm is connected to an actuating member that extends in front of the cutter head were a nail positioning pad is disposed on the actuating member adjacent the cutter head and where a user pushes downwardly on the actuating member to move the lower clipper arm upwardly toward the upper clipper arm to actuate the cutter head to cut a nail positioned in the cutter head.

15 Claims, 5 Drawing Sheets

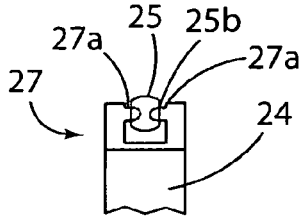
FIG. 3
FIG. 7
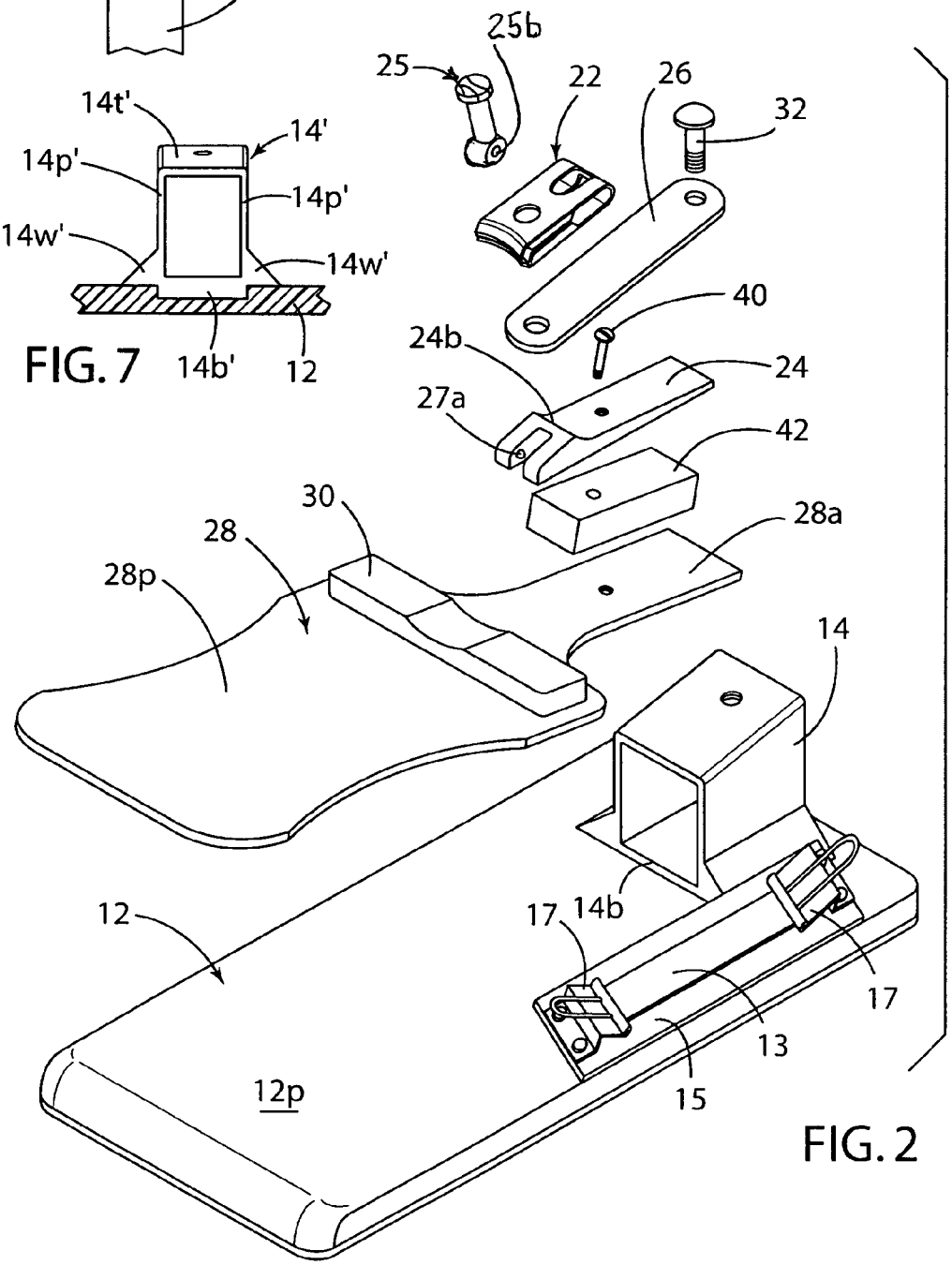
FIG. 2

NAIL CLIPPING APPARATUS

FIELD OF THE INVENTION

The present invention relates to a nail clipping apparatus operable using one hand or one foot.

BACKGROUND OF THE INVENTION

Some individuals, due to age, injury or disability, lack strength and/or dexterity in one hand required to independently operate conventional finger nail clippers in widespread use. Moreover, individuals having amputation of a hand also suffer the same problem. Similarly, individuals who are unable to bend over to clip their toenails also suffer the same problem. Such individuals often have difficulty clipping their nails using standard mechanical nail clippers.

Motorized nail clippers are available for use by individuals, but are disadvantageous in that the motorized nail clipper cannot be operated with one hand, does not remain stable on a surface, and is uncomfortable for some users due to the electric motor.

A mechanical nail clipper mounted to a base, which is secured in position by suction cups, also is available for use by individuals. However, this is disadvantageous in that the nail clipper cannot be operated with one hand and is not sturdy under pressure of the user's hand.

SUMMARY OF THE INVENTION

The present invention provides a nail clipping apparatus which is operable by an individual using one hand or foot, which is stable in use, which allows the user to comfortably clip his/her nails, and which permits clipping around the periphery of the nails.

In an illustrative embodiment of the invention, a nail clipping apparatus comprises a base having an upstanding support member and a nail clipper disposed on the support member. The nail clipper includes a rotatable cutter head that resides on a nail clipper arm connected to the support member. The cutter head is rotatable by the user to different angular positions in order to clip around the front and side peripheries of a nail.

In a further illustrative embodiment of the present invention, the nail clipping apparatus has a cutter head actuated to cut the user's nail through a pivoting movement of a lower clipper arm upwardly toward an upper clipper arm on which the cutter head resides. The upper clipper arm is connected to the support member and the lower clipper arm is connected to an actuating member that extends in front of the cutter head where a nail positioning pad is disposed on the actuating member adjacent the cutter head and where a user pushes downwardly on the actuating member with his/her hand or foot to move the lower clipper arm upwardly toward the upper clipper arm to actuate the cutter head to cut a nail positioned in the cutter head. The cutter head can be rotatably disposed on the upper clipper arm to permit clipping around the periphery of a nail by the user's rotation of the cutter head.

The nail clipping apparatus of the present invention is advantageous in that the user can clip or cut his/her nails using one hand or one foot in comfortable manner. The user can clip or cut around the periphery of his/her nails by adjusting angular position of the cutter head.

These and other features and advantages of the present invention will be set forth in the following detailed description taken with the following drawings.

DESCRIPTION OF THE DRAWINGS

FIG. 2 is an exploded view of the nail clipping apparatus of FIG. 1.

FIG. 3 is a partial view of the pivot connection between the lower clipper arm and the fastener pin.

FIG. 7 is a partial sectional view of the base and a one-piece support thereon.

DESCRIPTION OF THE INVENTION

Figure 1:
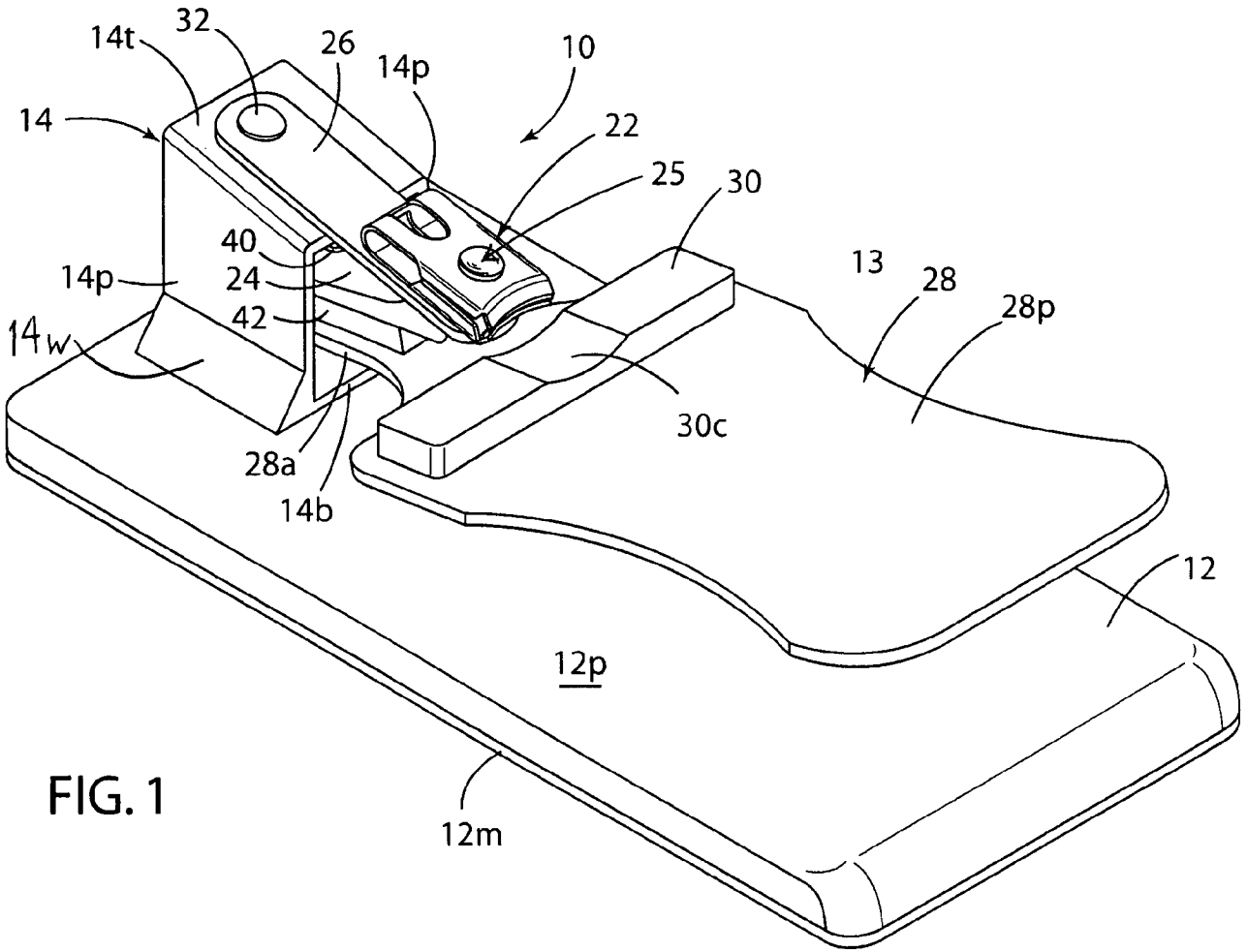
FIG. 1 is perspective view of a nail clipping apparatus pursuant to an illustrative embodiment of the invention.

In one embodiment, the present invention provides a nail clipping apparatus 10 which is operable by an individual using one hand or one foot, which is stable in use, which allows the user to comfortably clip his/her nails, and which permits clipping around the periphery of the nails. The invention envisions clipping of a user's fingernail, thumbnail, and/or toenail.

Referring to FIGS. 1-5, an illustrative embodiment of a nail clipping apparatus 10 pursuant to the present invention is shown comprising a base 12 having an upstanding support 14 thereon. The base 12 can be a flat plate 12*p* of any suitable material, such as polycarbonate or other suitable material. The base 12 can have an non-slip mat 12*m*, or non-slip rubber feet, suction cups, or other non-slip feature, to keep the base stationary in use. The mat 12*m* can be attached by adhesive or other technique on the bottom base surface 12*b*. The mat 12*m* can comprise a commercially non-slip mat available from Dycem Limited, Warwick Central Industrial Park, R.I. 02886.

The upstanding support 14 can comprise a one-piece support having spaced apart upstanding sides 14*p* with angled side wings 14*w*, an angled top surface 14*t* integral with the sides 14*p* and a polygonal base 14*b* that is integral with the sides 14*p* and that is received and adhered or otherwise fastened in a complementary shaped recess in the base 12 with the side wings 14*w* resting on the base 12. The one-piece support 14 can be made of any suitable material such as polycarbonate or other suitable material and can be made by machining a polycarbonate block. In an alternate embodiment, the support 14 can comprise separate side, top and bottom plate members fastened together with fasteners or adhesive and similarly to the base 12.

The base 12 and the support 14 provide a stable platform for use of the nail clipping apparatus by an individual using one hand as described and shown below (or one foot).

The base 12 can include an optional nail file 13 disposed on a support plate 15 fastened on the base, FIG. 2. The nail file can include, but is not limited to, a conventional emory board, a metal nail file, or other nail file, releasably attached at opposite end by clips 17 to the support plate 15 so that the nail file can be replaced as needed, FIG. 4.

The nail clipping apparatus includes a nail clipper 20 disposed on the support 14. The nail clipper includes a rotatable cutter head 22 having upper and lower cutting jaws 22*a*, 22*b* usually open by virtue of the spring properties of the cutter head and actuated to close together to cut the user's fingernail, thumbnail or toenail by pivoting movement of a lower clipper arm 24 upwardly toward an upper clipper arm 26 on which the cutter head 22 resides. The nail clipper 20 can comprise a commercially available Sally Hansen LaCross toenail clipper (or fingernail clipper) available from LaCross, 726 Reckson Plaza, Uniondale, N.Y. 11553, but inverted when it is connected to the support 14 as shown best in FIGS. 1, 4 and 4A so that in the inverted position on the support 14, the clipper arm 26 is connected to the angled top surface 14*t* and the clipper arm 24 is connected to an actuating member 28 that extends in front of the cutter head 22 were a nail positioning pad 30 is disposed on the actuating member 28 adjacent the cutter head 22. The clipper arm 26 can be modified to remove a plastic covering thereon as-purchased to facilitate attachment to the support.

Figure 6B:
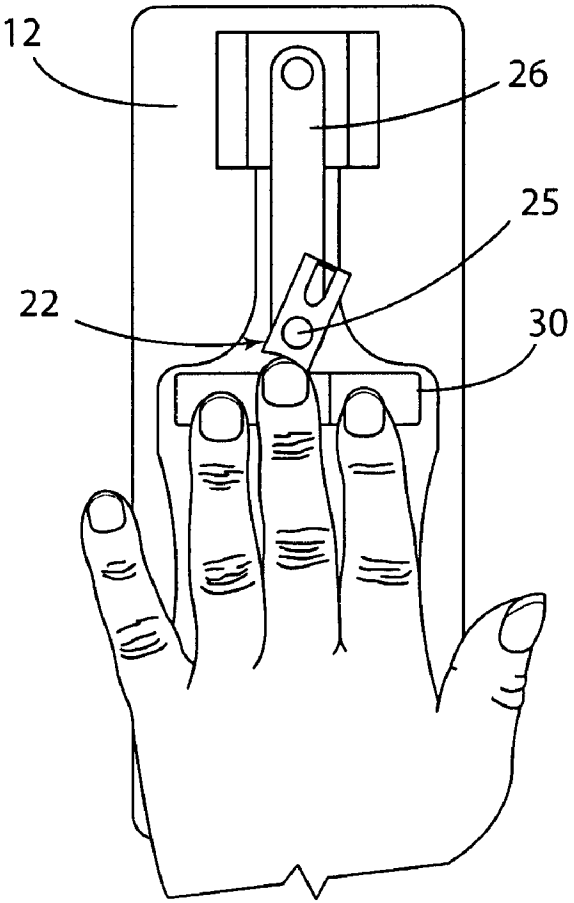
FIGS. 6A, 6B are plan views of the nail clipping apparatus showing a user's hand on the actuating member with the cutter head aligned with the upper clipper arm to clip a front of the middle fingernail, FIG. 6A, and rotated to an angular position relative to the upper clipper arm to clip the periphery of a middle fingernail.
Figure 6A:
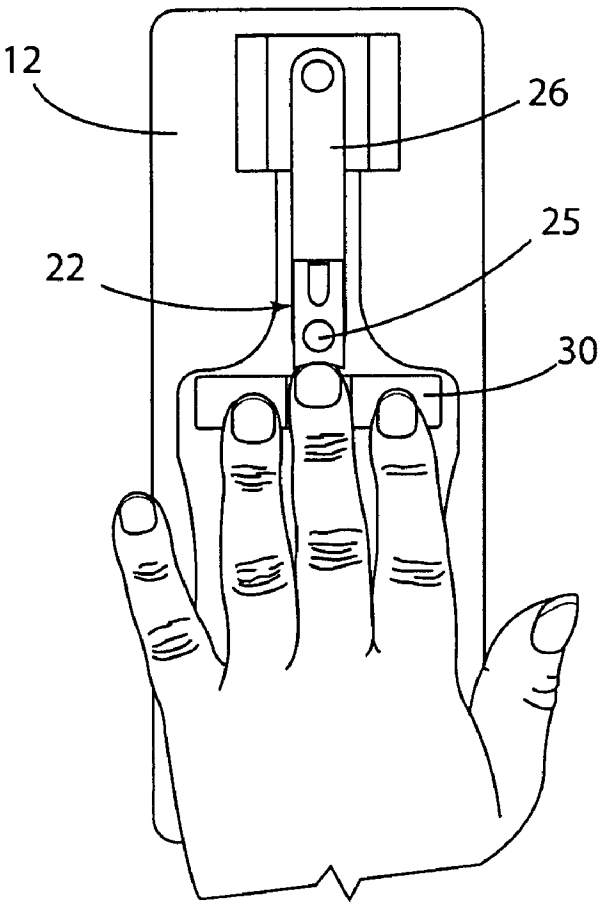

The cutter head 22 is rotatably disposed on the upper clipper arm 26. In particular, the cutter head 22 is rotatably disposed on a fastener pin 25 that connects cooperating end regions 26*e*, 24*e* of the upper clipper arm 26 and the lower clipper arm 24 and the cutter head 22. The fastener pin 25 is rotatable about its axis. In FIGS. 1 and 6A, the cutter head 22 is aligned along the longitudinal axis of the clipper arm 26 to cut the front periphery of the nail. The cutter head 22 can be manually rotatable relative to the upper clipper arm 26 by the user to different angular position(s) to cut a side periphery of a fingernail as shown in FIG. 6B, or a thumbnail or a toenail. The entire periphery of a nail thereby can be clipped.

The lower clipper arm 24 is pivotably connected to a lower end of the fastener pin 25 by a yoke connection 27 shown in FIG. 3 where side projections 27*a* of arm 24 extend into side-bores 25*b* of a slightly enlarged, rounded lower end of the fastener pin 25. The upper end of the fastener pin 25 is flattened after assembly with the clipper arms/cutter head to form an upper flattened shaft end. The lower clipper arm 24 includes a bend 24*b* proximate the fastener pin 25 in usual manner so that closing force is exerted on the lower cutter jaw 22*b* by the clipper arm 26 when the clipper arm 24 is pivoted upwardly toward the clipper arm 26 by the user's pushing downwardly on the paddle region 28*p* of the actuating member 28 using the user's hand or foot.

The upper clipper arm 26 is fixedly connected to the angled top surface 14*t* of the support 14 at an end region of the upper clipper arm by a fastener 32, such as a screw or any other fastening element. The upper clipper arm 26 extends forwardly away from the support 14 preferably at a downward acute angle (relative to horizontal) that replicates the angle of the top connector plate 14*t*, such as about 17.5 degrees or other suitable acute angle below horizontal, although the upper clipper arm can be oriented horizontally or at other angles. This cutter head angle advantageously orients the cutter head 22 at a similar angle to allow a user ready visibility of the fingernail, thumbnail or toenail relative to the cutter head and allows nail clippings to fall down onto base 12, eliminating random projecting of clippings.

The lower clipper arm 24 also is connected to an elongated arm 28*a* of an actuating member 28 that extends forwardly in front of the cutter head 22 at an upward acute relative to horizontal, such as about 14 degrees or other upward acute angle above horizontal, where the positioning pad 30 is disposed on an enlarged paddle or platform region 28*p* of the actuating member 28, although the lower clipper arm 24 can be oriented horizontally or at other angles. The pad 30 includes a groove or channel 30*c* located adjacent and in front of the cutter head 22 to receive a finger, thumb or toe of the user. The lower clipper arm 24 is connected to the actuating member 28 by one or more fasteners such as a screw 40 and nut (not shown) below the clipper arm, adhesive, or other technique. A wedge 42 is disposed between the lower clipper arm 28 and the actuating member 28 so as to position the positioning pad 30 at a desired level in front of the cutter head 22 so that the fingernail, thumbnail or toenail can be inserted between the cutting jaws 22*a* and 22*b* of the cutter head.

The positioning pad 30 can comprise foam plastic material, such as Neoprene or any other suitable material. The positioning pad 30 can be attached to the enlarged paddle or platform region 28*p* of the actuating member 28 by adhesive or any other fastening technique.

Figure 4:
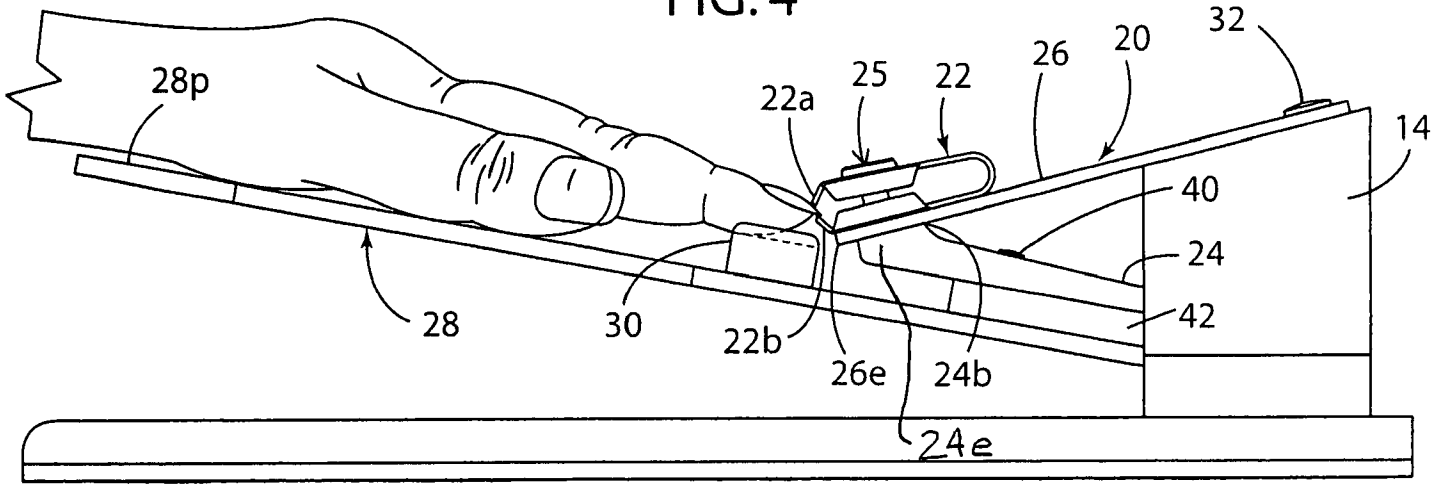
FIGS. 4, 4A and 5 are perspective view of the nail clipping apparatus showing a user's hand on the actuating member during clipping a fingernail for FIGS. 4A, 4B and a thumbnail on a large hand, FIG. 5.
Figure 4A:
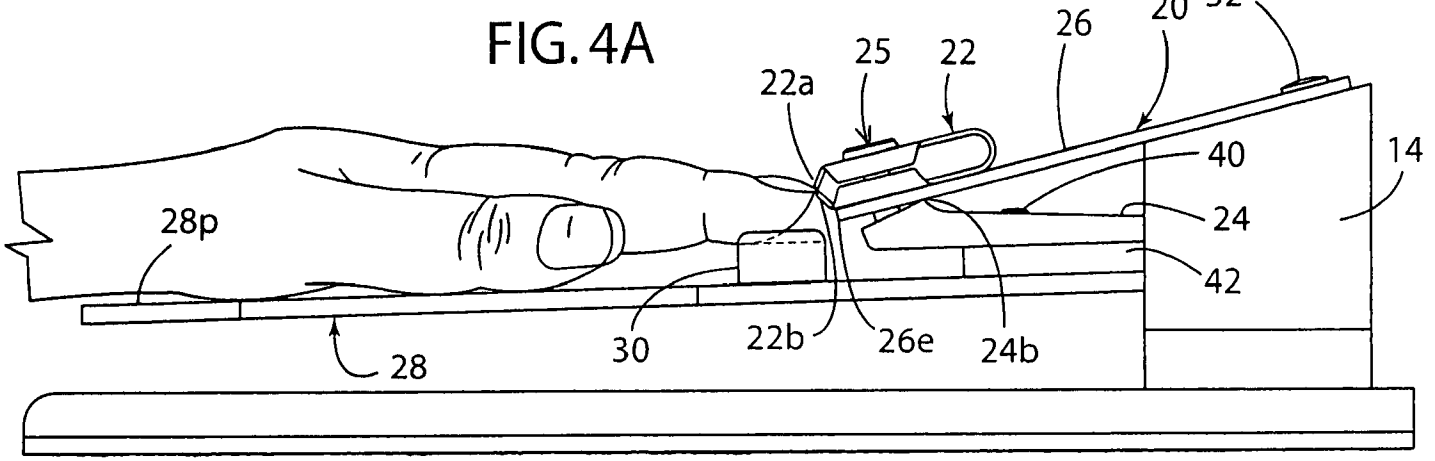
Figure 5:
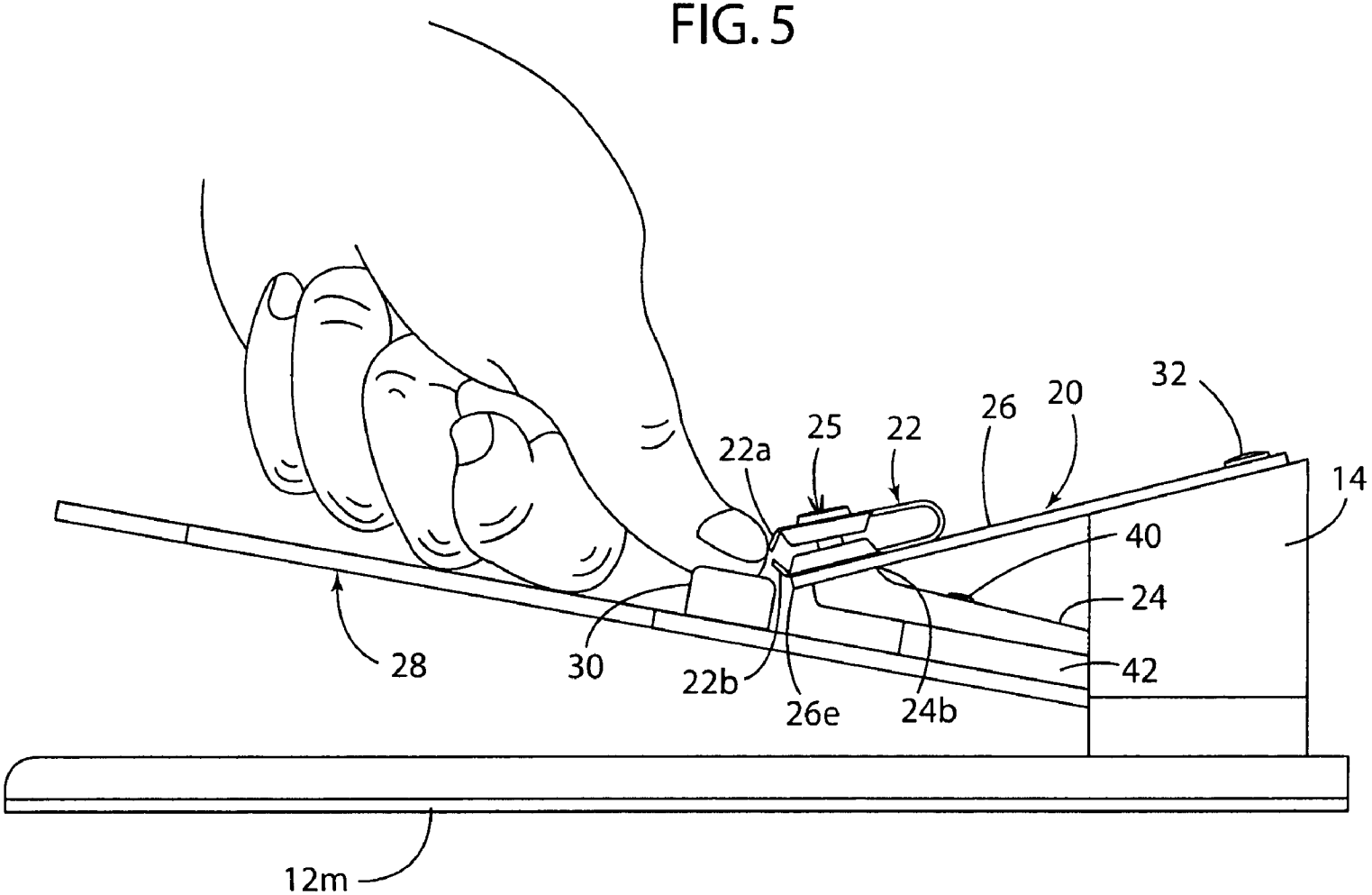

The enlarged paddle region 28*p* of the actuating member 28 is adapted to receive the user's hand or foot, or a portion thereof, as illustrated for a user's hand in FIGS. 4, 4A and 5. For example, FIGS. 4, 4A show the palm of the user's hand laid flat on the paddle region 28*p* with a index finger lying in pad channel 30*c* with the fingernail in the cutter head 22. FIG. 5 shows the knuckles of the fingers of the user's larger hand on the paddle region 28*p* with the thumb residing in pad channel 30*c* to position the thumbnail in the cutter head 22. FIG. 5 is useful for users with large hands to clip his/her nails and/or for thumbnail clipping for some users. In FIGS. 4, 4A and 5, the user pushes downwardly on the paddle region 28*p* of the actuating member using his/her hand to move the clipper arm 24 upwardly toward the clipper arm 26 to actuate the cutter head jaws 22*a*, 22*b* to cut the fingernail or thumbnail positioned in the cutter head. FIGS. 6A, 6B are plan views of the nail clipping apparatus showing a user's hand on the actuating member 28 with the cutter head 22 aligned with the upper clipper arm 26 to clip a front of the middle fingernail, FIG. 6A, and rotated to an angular position relative to the upper clipper arm to clip the side periphery of a middle fingernail, FIG. 6B. The entire front and side peripheries of a fingernail, thumbnail or toenail can clipped by the user's rotatably adjusting the cutter head 22 to this end and then pushing down on the actuating member 28. In FIGS. 6A, 6B, the user can press down on the paddle with his/her palm or with his/her thumb to cut a nail.

In clipping a toenail, the user can sit in a chair with the nail clipping apparatus 10 on the floor for example. The user, sitting in the chair, can simply place his/her foot on the paddle region 28*p* with a toe on the positioning pad 30 to position the toenail thereof for cutting by cutter head 22 when the user presses downwardly with his/her foot on the paddle region.

The actuating member 28 and paddle region 28*p* can have any suitable shape. The contour shown at paddle region 28*p* allows for increased ease of use in cutting nails and also serves to provide a carrying handle for ease of transportation of the apparatus.

The invention envisions mounting a vision magnifying device, such as a magnifying glass (not shown), on the base or support above the cutter head in a manner to improve vision of the nail clipping area by a user who may have less-than perfect eye sight.

While certain embodiments of the invention have been described in detail above, those skilled in the art will appreciate that changes and modifications can be made therein within the scope of the invention as set forth in the appended claims.

What is claimed is:

1. A method of clipping a nail of a user, comprising placing one of a user's hand or foot on a positioning pad on an upwardly facing surface of an actuating member that extends in front of a cutter head with a nail of that hand or foot proximate the cutter head, moving the actuating member downwardly by that same hand or foot pushing down on the upwardly facing surface of the actuating member to pivot a lower clipper arm upwardly toward an upper clipper arm which is fastened on a support of a base and on which the cutter head resides to close jaws of the cutter head to clip the nail, whereby the user is able to cut the nail using one hand or foot.

2. The method of claim 1 including rotating the cutter head relative to the upper clipper arm to clip a periphery of the nail.

3. A nail clipping apparatus for cutting a nail of a user, comprising a base having an upstanding support member and a nail clipper disposed on the support member, said nail clipper having a rotatable cutter head disposed on a nail clipper arm that is connected to the support member and being manually rotatable to different angular positions relative to the nail clipper arm by the user to cut around the front and side periphery of the nail, said cutter head having upper and lower cutting jaws for cutting a nail, and an actuating member extending in front of the cutter head and operably connected to the cutter head to close the cutter head cutting jaws by upward movement of the lower cutting jaw when the actuating member is pushed downwardly by the user's hand or foot pushing down on the actuating member, said actuating member having an upwardly facing surface on which one of a user's hand or foot is placed to cut a nail on that hand or foot by that same hand or foot pushing down on the actuating member, whereby the user is able to cut the nail using one hand or foot.

4. The apparatus of claim 1 wherein the cutter head is rotatable on a fastener that connects the cutter head, an upper clipper arm that is connected to the support member, and a lower clipper arm that is movable toward the upper clipper arm to actuate the cutter head.

5. The apparatus of claim 1 wherein the cutter head is oriented at a downward acute angle relative to horizontal toward a finger or toe positioning pad that is disposed on the upwardly facing surface of the actuating member in front of the cutter head.

6. A nail clipping apparatus for cutting a nail of a user, comprising a base having an upstanding support member and a nail clipper disposed on the support member, said nail clipper having a cutter head actuated to cut the user's nail by pivoting movement of a lower clipper arm upwardly toward an upper clipper arm on which the cutter head resides, wherein the upper clipper arm is connected to the support member and the lower clipper arm is connected to an actuating member that extends in front of the cutter head where a positioning pad is disposed on the actuating member adjacent the cutter head and where a user pushes downwardly on the actuating member to move the lower clipper arm upwardly toward the upper clipper arm to actuate the cutter head to cut a nail positioned in the cutter head.

7. The apparatus of claim 6 wherein the cutter head is rotatably disposed on the upper clipper arm.

8. The apparatus of claim 7 wherein the cutter head is connected to cooperating end regions of the upper clipper and the lower clipper arm by a fastener pin on which the lower clipper member is pivotably disposed proximate an end of the fastener pin and on which the cutter head is rotatably disposed proximate an opposite end of the fastener pin.

9. The apparatus of claim 8 wherein the lower clipper arm includes a bend proximate the fastener.

10. The apparatus of claim 6 including a wedge between the lower clipper arm and the actuating member to position the positioning pad relative to the cutter head.

11. The apparatus of claim 6 wherein the cutter head upper is oriented at a downward acute angle relative to horizontal toward the positioning pad.

12. The apparatus of claim 6 wherein the cutter head comprises upper and lower nail cutting jaws.

13. The apparatus of claim 6 wherein the actuating member includes an enlarged paddle region in front of the cutter head and on which the user's hand or foot can be placed.

14. The apparatus of claim 6 further including a nail file disposed on the base.

15. A nail clipping apparatus for cutting a nail of a user, comprising a base having an upstanding support member and a nail clipper disposed on the support member, said nail clipper having a cutter head with upper and lower cutting jaws, a lower clipper arm that is pivotable upwardly toward an upper clipper arm on which the cutter head resides wherein an upward closing force is exerted on the lower cutting jaw by the upper clipper arm when the lower clipper arm is pivoted upwardly by an actuating member extending in front of the cutter head, said actuating member being operably connected to the lower clipper arm to pivot the lower clipper arm upwardly when the actuating member is pushed downwardly by the user's hand or foot pushing down on the actuating member, said actuating member having an upwardly facing surface on which one of a user's hand or foot is placed to cut a nail on that hand or foot by that same hand or foot pushing down on the actuating member, whereby the user is able to cut the nail using one hand or foot.

* * * * *

UNITED STATES PATENT AND TRADEMARK OFFICE

CERTIFICATE OF CORRECTION

PATENT NO. : 8,356,414 B2
APPLICATION NO. : 12/075099
DATED : January 22, 2013
INVENTOR(S) : Jared Wendorf et al.

It is certified that error appears in the above-identified patent and that said Letters Patent is hereby corrected as shown below:

In the Claims:

Column 5, Claim 4, line 27; replace “claim 1” with --“claim 3”--.

Column 5, Claim 5, line 32; replace “claim 1” with --“claim 3”--.

Signed and Sealed this
Thirtieth Day of April, 2013

Teresa Stanek Rea
*Acting Director of the United States Patent and Trademark Office*